United States Patent [19]

Vann

[11] 3,990,507

[45] Nov. 9, 1976

[54] HIGH TEMPERATURE PERFORATING APPARATUS

[76] Inventor: Roy R. Vann, 804 Clowe Ave., Artesia, N. Mex. 88210

[22] Filed: Oct. 14, 1975

[21] Appl. No.: 622,427

Related U.S. Application Data

[62] Division of Ser. No. 522,529, Nov. 11, 1974, Pat. No. 3,912,013.

[52] U.S. Cl. ..... 166/55.1; 166/63; 166/297; 175/4.56

[51] Int. Cl.[2] ..... E21B 43/119

[58] Field of Search ..... 166/55, 55.1, 55.2, 166/63, 297, 299; 175/4.51, 4.56; 102/20, 24

[56] References Cited

UNITED STATES PATENTS

| | | | |
|---|---|---|---|
| 2,866,508 | 12/1958 | Church | 166/55.1 X |
| 2,974,739 | 3/1961 | Dean | 175/4.51 |
| 3,058,523 | 10/1962 | McElheny | 166/55.1 X |
| 3,190,372 | 6/1965 | Johnson | 102/20 X |
| 3,193,013 | 7/1965 | Whiteside | 166/63 X |
| 3,199,287 | 8/1965 | Kinley | 166/63 X |
| 3,530,948 | 9/1970 | Garrett | 166/55.1 X |
| 3,706,340 | 12/1972 | Shuster | 166/297 |
| 3,706,344 | 12/1972 | Vann | 166/297 |

*Primary Examiner*—Stephen J. Novosad
*Assistant Examiner*—Richard E. Favreau
*Attorney, Agent, or Firm*—Marcus L. Bates

[57] ABSTRACT

A high temperature well completion method is carried out by releasably suspending a perforating gun uphole in a relative low temperature region of the borehole. A wireline actuated releasable coupling drops the armed gun, and the gun comes to rest adjacent to a hydrocarbon bearing formation located downhole in a high temperature region of the borehole. The downward motion of the gun is arrested at a preselected location, causing the gun to be detonated and the casing to be perforated before the gun reaches temperature equilibrium.

10 Claims, 9 Drawing Figures

HIGH TEMPERATURE PERFORATING APPARATUS

This application is a division of application Ser. No. 522,529, filed Nov. 11, 1974, now U.S. Pat. No. 3,912,013 issued Oct. 14, 1975.

BACKGROUND OF THE INVENTION

After a borehole has been formed into the earth and cased, it is necessary to communicate the hydrocarbon bearing formation through which the well bore extends with the interior of the casing so that production fluid can flow uphole to the surface of the earth. There are deep wells exceeding 15,000 feet in depth which have extremely high temperature gradients as measured from near the surface of the earth to the bottom of the borehole. The temperature at the production formation often exceeds 400° F. For this reason some tool strings must be run into proximity of the bottom of the borehole with great caution, otherwise, the excessive temperature will bring about deleterious effects to some components thereof.

This is especially so with jet perforating apparatus for the obvious reason that the various components thereof cannot endure such an elevated temperature. More importantly, the electrical and explosive apparatus associated with the circuitry cannot endure this temperature. The explosives become ultrasensitive and change in chemical composition at these excessive temperatures.

Others have attempted to employ special high temperature explosive material and devices which can endure for a while at elevated temperatures; however, it is much preferable to utilize well known explosive apparatus, circuitry, devices, and techniques wherever it is possible, thereby taking advantage of years of accumulated knowledge.

SUMMARY OF THE INVENTION

Method and apparatus for completing a high temperature zone of a borehole. A perforating gun is suspended from a tubing string and located within a relative low temperature zone of the borehole. A packer and a releasable coupling member is interposed in the tubing string, with the coupling member being interposed between the gun and the packer. A stop member, against which the gun can impact, is located downhole in a high temperature region of the borehole, in an underlying position respective the gun and to a hydrocarbon bearing formation.

The gun has a detonator which is actuated when the gun is suddenly arrested by engagement with the stop member. The relative position of the gun, stop member, detonator, and hydrocarbon bearing formation is arranged or selected so that the coupling member can be parted to drop the gun, causing the gun to fall downhole, whereupon its motion is arrested by the stop member, thereby causing the charges in the gun to be detonated, and the well completed.

Accordingly, the present invention has for its primary object a method by which a high temperature zone in a borehole can be successfully perforated.

Another object of the invention is to enable a production formation to be completed by utilizing conventional shaped explosive charges which are detonated in accordance with the present invention.

A further object of this invention is the provision of a method of completing a high temperature zone of a borehole.

Still another object of the invention is the provision of method and apparatus for perforating a high temperature hydrocarbon bearing zone in a borehole using conventional exlosives.

Another and still further object of this invention is the provision of a method of using conventional perforating guns downhole in a high temperature region of a borehole which is at a temperature in excess of the designed operating temperature of the perforating gun apparatus.

A further object of this invention is the provision of apparatus for perforating a high temperature region of a borehole, by employment of wireline actuated equipment.

Still another object of this invention is to provide a perforating system by which a high temperature zone of a borehole can be completed using conventional explosives.

These and other objects of the invention are attained by following the teachings set forth in the above abstract, summary, and the apended claims of this patent specification.

DETAILED DESCRIPTION OF THE PREFERRED EMBODIMENT

Figure 1:
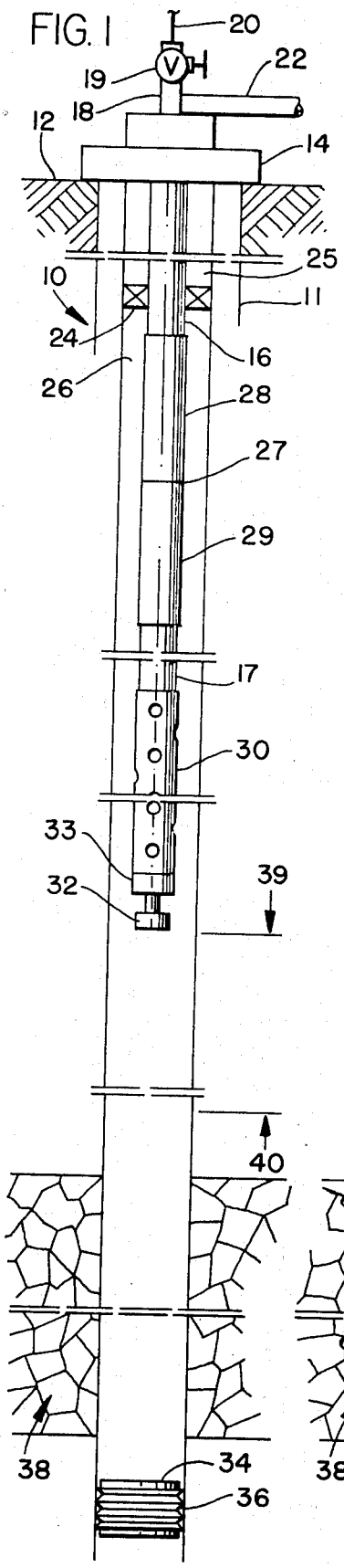
FIG. 1 is a part diagrammatical, part schematical, cross-sectional representation of a borehole formed into the earth and with apparatus made in accordance with the present invention being associated therewith.

Throughout the various figures of the drawings, whenever it is practical or logical to do so, like or similar numerals will usually indicate or refer to like or similar elements.

In the figures of the drawings, a borehole 10 extends through a surface casing 11 and below the surface 12 of the ground. The upper terminal end of the casing is connected to the wellhead 14 in a conventional manner. Production tubing 16 and 17 are series connected and concentrically disposed within the cased borehole. The christmas tree 18 has a usual lubricator and valve 19 attached thereto so that a wireline 20 can be run downhole into the tubing string thereby carrying out various downhole operations in a manner understood and appreciated by those skilled in the art. Outflow valve 22 conducts flow of fluid from the production tubing string.

A packer 24, which can take on any number of different known forms, isolates the upper borehole annulus 25 from the lower borehole annulus 26. A releasable coupling member 27, preferably made in accordance with my co-pending patent application Serial No. 517,391, filed Oct. 23, 1974, is comprised of separable members 28 and 29 which can be disengaged from one another by manipulation of a common fishing tool with an ordinary wireline 20, or with uphole tubing pressure, as will be more fully understood later on in this disclosure.

A jet perforating gun 30, made in accordance with the present invention, is provided with an actuating shaft 32 which causes a firing head 33 to detonate the various shaped charges associated therewith upon impact of the actuator with fixed abutment member 34. An anchoring device 36 affixes the abutment member at a predetermined location downhole in the borehole, so that the shaped charges, when detonated, perforate the casing adjacent to a hydrocarbon producing zone 38.

A moderate temperature zone 39 exists uphole in the borehole where temperatures are below the boiling point of water. Further downhole there exists a high temperature zone 40, often in excess of 400° F, wherein ordinary electrical components and explosives associated with jet perforating guns cannot safely endure if permitted to reach equilibrium therein.

Figure 3:
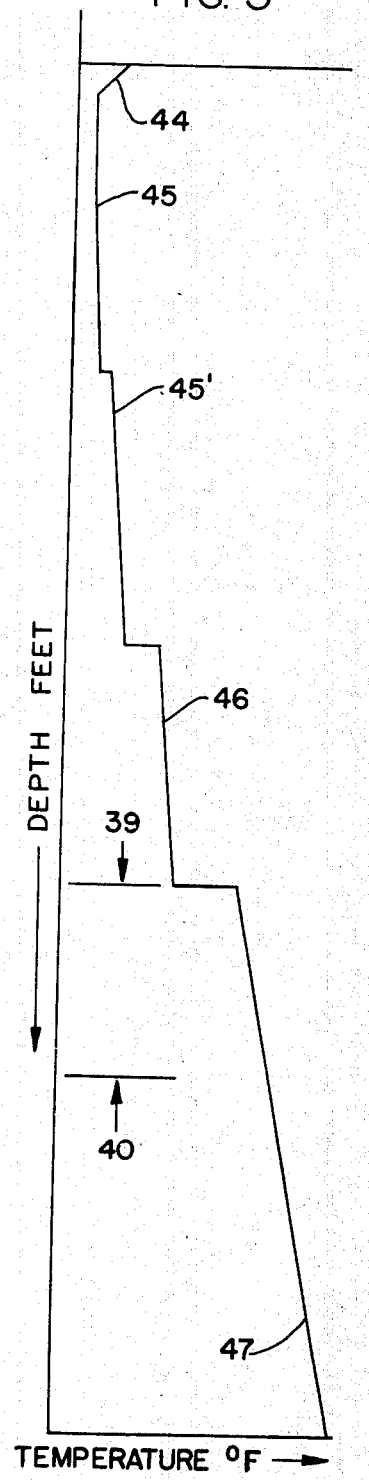
FIG. 3 is indexed with FIGS. 1 and 2 and sets forth a hypothetical illustration of the temperature gradient encountered downhole in the borehole of the previous figures.

In the hypothetical representation of FIG. 3, the temperature decreases at 44 as one penetrates the surface of the earth, where the temperature remains fairly constant at 45, and then begins to increase at a more rapid rate at 45'. The temperature continues increasing at 46 to define the upper limit of the before mentioned moderate temperature zone 39, whereupon the temperature continues to increase as one travels downhole until the before mentioned high temperature zone 40 is encountered.

In the claims, the term "relative low temperature" is intended to define a temperature at which perforating gun components, such as shaped charges, prima cord, blasting caps, and electrical gun circuitry, can endure for several days, whereas the term "relative high temperature" defines an elevated temperature at which the gun components cannot endure long enough to be run downhole and fired in a conventional manner. Any temperature zone above numeral 39 is a "relative low temperature zone" while any temperature zone at or below numeral 40 is a "relative high temperature zone."

Figure 4:
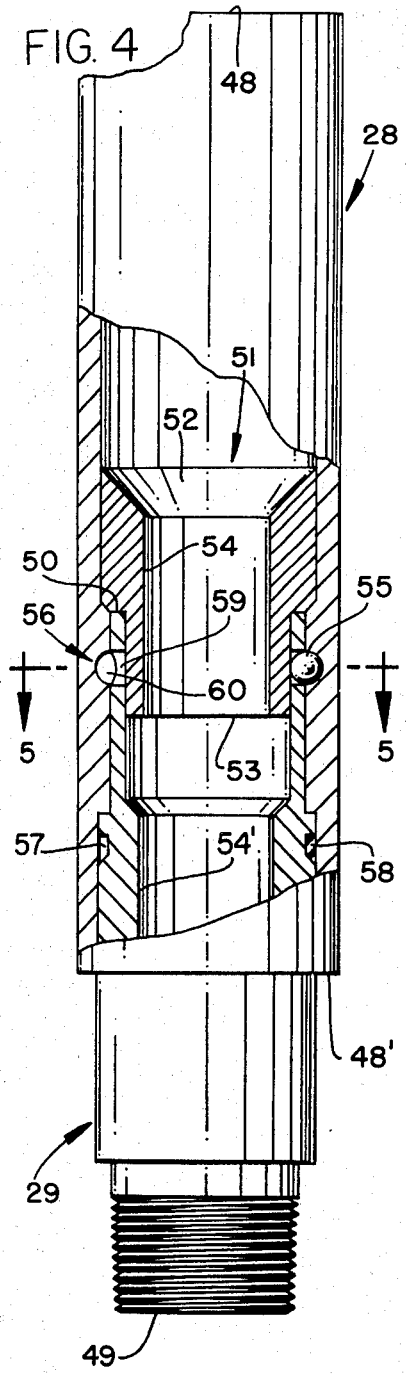
FIG. 4 is a side elevational view, partly in longitudinally cross-section, illustrating one form of part of the apparatus which is used in carrying out the method of the present invention.
Figure 5:
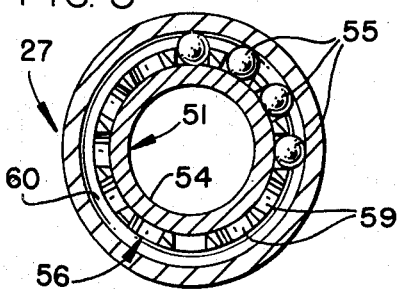
FIG. 5 is a cross-sectional view taken along line 5—5 of FIG. 4.

FIGS. 4 and 5 disclose the details of the before mentioned wireline actuated releasable coupling member 27. The coupling member comprises the before mentioned separable upper and lower members 28 and 29 which are series connected into the tubing string. Upper member 28 has an upper box end portion 48 threadedly engaged with tubing 16, and further includes a terminal lower edge portion 48'.

Lower member 29 has a lowermost edge portion 49 in the form of a pin which threadedly engages tubine 17. The upper edge portion of member 29 is seen illustrated by the numeral 50. Numeral 51 broadly illustrates a releasing member having an upper conical shaped entrance 52, and a lower edge portion 53 in the form of a shoulder, which is engagable by several known wireline operated fishing tools so that the member can be engaged and forced to move axially in an uphole direction into engagement with the shoulder formed by the lower end of the tubing (not shown). Those skilled in the art know several different fishing tools which are suitable for this purpose, and therefore the details thereof will be omitted.

An axial passageway extends through the concentrically arranged upper, lower, and releasable members with the passageway being broadly indicated by the numerals 54 and 54'. A plurality of radially spaced load transferring members, in the form of steel balls 55, are seated within individual radially spaced apart cavities 56.

Groove 57 receives chevron ring 58 therein so as to form a fluid tight seal between the members, and therefore preclude fluid flow into the longitudinally extending central passageway.

The before mentioned cavity is formed by a plurality of radially spaced apart ports 59 placed in communication with a circumferentially extending annular cavity 60 so that any one of the balls are individually held within its respective cavity by an outer wall surface of the skirt portion of the releasing member. The balls each are biased towards the skirt member because of the geometrical configuration of the port and cavity. Reference is made to my co-pending patent application for further details of the releasable coupling.

Figure 8:
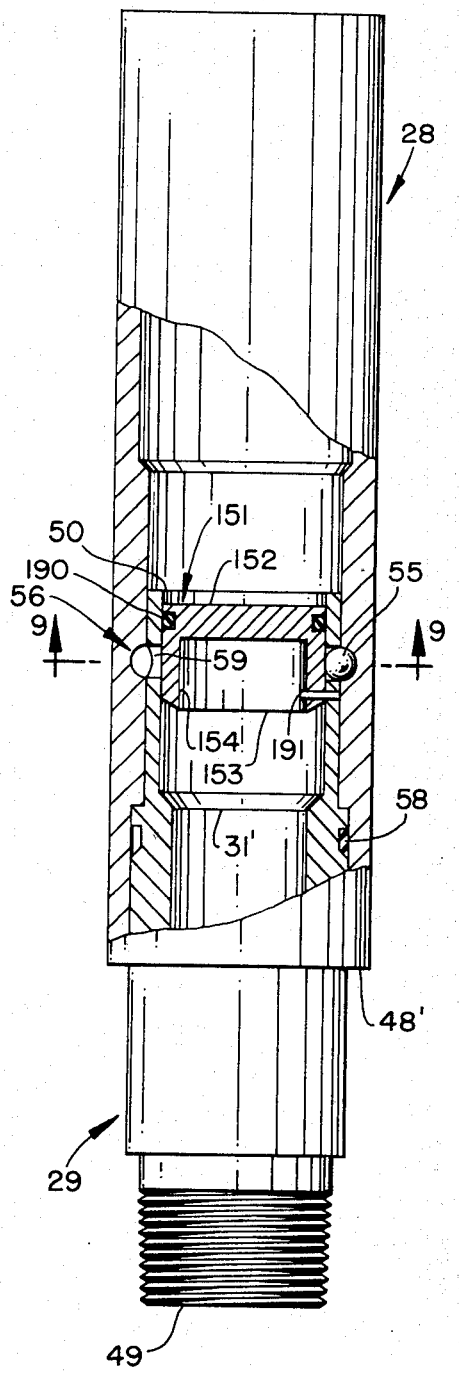
FIG. 8 is a longitudinal, part cross-sectional view of a modified embodiment of the apparatus seen in FIG. 4; and, FIG. 9 is a cross-sectional view taken along line 9—9 of FIG. 8.
Figure 9:
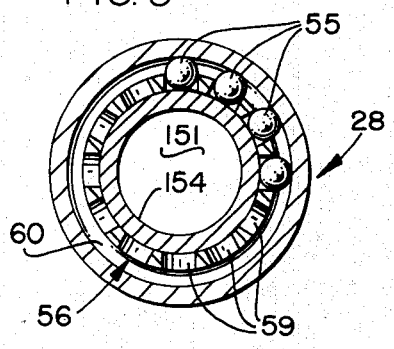

In FIGS. 8 and 9, there is disclosed a fluid actuated releasable coupling having a fluid actuated releasing member 151 in the form of a piston. The piston has a wall surface 152, a lower edge portion 153, and a circumferentially extending skirt portion 154. Spaced seals 190 in the form of o-rings set in a suitable annular groove form a slidable seal which seals the piston wall and the axial passageway 54 against fluid flow thereacross. Shear pin 191 can be of any number and of a selected diameter so as to require a predetermined pressure differential thereacross before movement thereof will occur.

Figure 2:
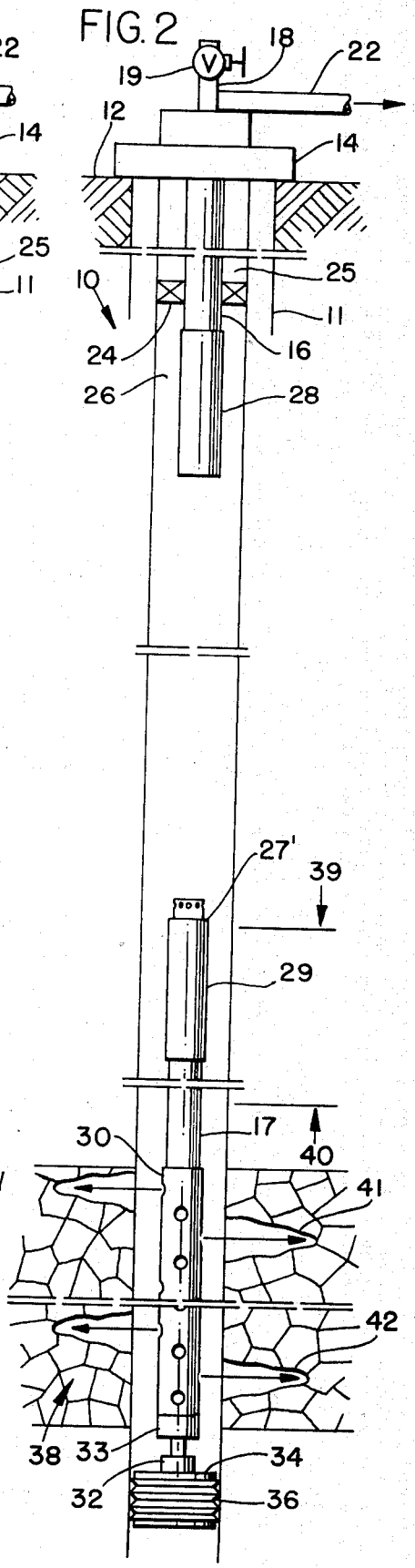
FIG. 2 is similar to FIG. 1 and shows the apparatus of the present invention in another of its operative configurations.
Figure 6:
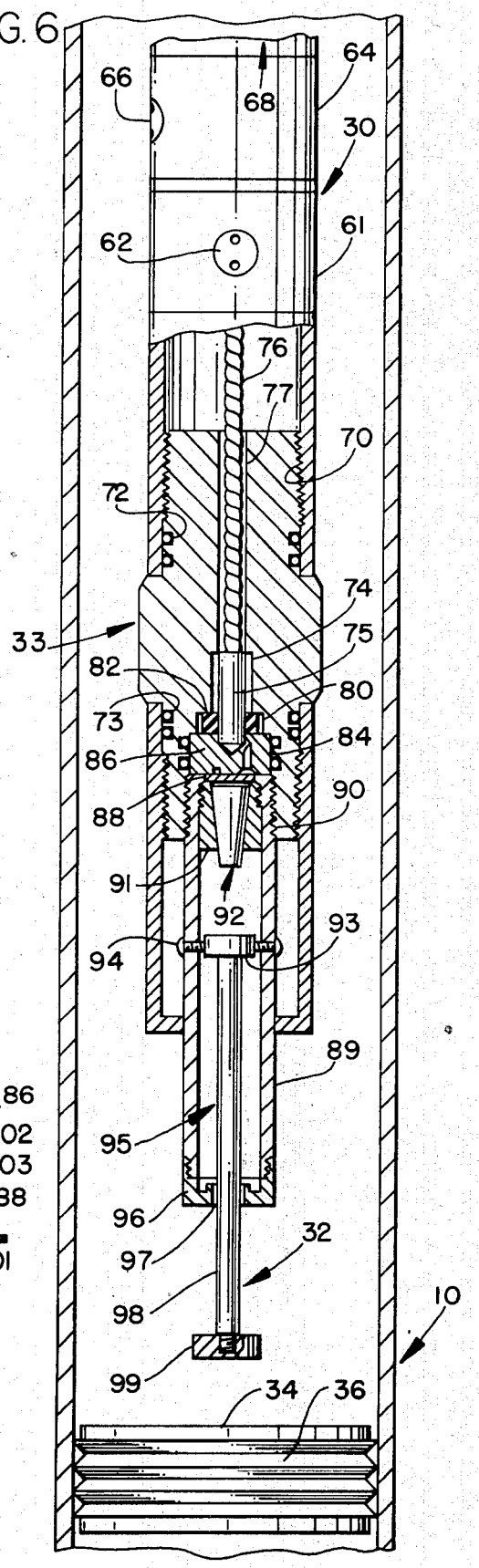
FIG. 6 is an enlarged, longitudinal, part cross-sectional view of part of the apparatus disclosed in FIG. 1.
Figure 7:
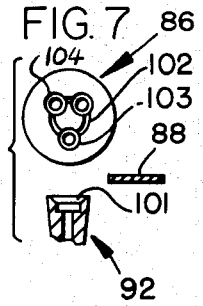
FIG. 7 is a part cross-sectional, part broken, disassembled view of part of the apparatus disclosed in FIG. 6.

Looking now to the details of FIG. 6, in conjunction with FIGS. 1, 2, and 7, the before mentioned jet perforating gun 30 is seen to have a plurality of charge containing chambers 61 and 64, each containing one or more shaped charges which are positioned behind sealed window 62 in the usual manner. The second chamber 64 likewise has associated therewith a shaped charge window 66 while any number of additional charges may be located uphole as broadly indicated by the arrow at numeral 68.

The spaced subs threadedly engaged each of the spaced charge containing chambers and the firing heat at 70, for example, while a suitable seal means 72 precludes leakage of fluid thereinto. Counterbore 74 contains a prima cord detonator in the form of a blasting cap 75 which is axially disposed therewithin, with the prima cord 76 having a marginal end inserted into the detonator, with the remaining end thereof suitably affized for detonating the various shaped charges located at 62 and 66. Counterbore 77 communicates the charge carrying chambers with the firing head. affixed Enlarged counterbore 80 sealingly receives resilient seal member 82 tightly compressed therewithin, while counterbore 84 sealingly receives a cartridge holder 86 tightly fitted therein. Disk 88 is held in place within the threaded axial bore 90, while plug 91 bears against the disk and houses a tapered firing pin 92 therewithin.

Reciprocating member 93 is held spaced from the firing pin in the illustrated position of FIG. 6 by shear pins 94. Chamber 95 is hermatically sealed by a suitable closure member 96 which includes a seal means affixed to the illustrated axial passageway at 97 leading therein so that a slidable shaft 98 can be sealingly and reciprocatingly received thereby when manipulated by an arresting member 99.

As seen in FIGS. 1, 6, and 7, when the gun is brought into contact with the fixed abutment 34, member 99 moves shaft 98 uphole so that member 93 engages and forces firing pin 92 into cutting engagement with disk 88, thereby detonating the three cartridges 104. Explosion of any one cartridge causes the dynamite cap to detonate the prima cord, and the prima cord detonates the shaped charges located at 62, 66, 68, thereby causing the jet perforators to penetrate the windows 62 and 66, the casing wall, and the formation. This action perforates the borehole, thereby establishing communication between the hydrocarbon producing formation and the well bore in the manner illustrated by numerals 41 and 42 of FIG. 2.

In carrying out the method of the present invention, the apparatus is assembled in the manner of FIGS. 1, 4, and 6. The lower stop member is positioned relative to the hydrocarbon producing formation so that the individually shaped charges will penetrate selected portions of the hydrocarbon producing zone in the manner illustrated in FIG. 2.

Packer 24 is positioned so that the releasable coupling member is therebelow, and further that the gun is positioned in a relatively low temperature zone 39 where the components thereof are not injured rather than a relatively high temperature zone 40 where the components thereof could not endure. Sometimes it is desirable to leave the gun in the illustrated position of FIG. 1 for several days before continuing with the process of completion of the well.

When it is desired to complete the well, a wireline fishing tool is run through the lubricator and downhole into engagement with shoulder 53 of the releasing member of the releasable coupling. Upon engaging the shoulder and lifting the releasing member uphole, the balls are forced radially inwardly from their cavities, thereby enabling members 28 and 29 to separate from one another, and causing the gun to fall downhole where the gun firing mechanism strikes abutment 34 thereby reciprocating shaft 98 uphole relative to the gun firing mechanism 33.

This action causes detonation of the shaped charges contained within the gun, whereupon deep penetration of the formation is effected in the illustrated manner indicated in FIG. 2. At the same time gaseous hydrocarbons are free to immediately flow through the newly formed perforations, where the gases flow uphole around the gun, into the upper member of the releasable coupling, through the tubing string 16 and through outlet 22, so that the well is immediately put on production.

The pressure operated releasable coupling of FIGS. 8 and 9 is employed where the use of a wireline is to be avoided. After the packer has been set, and the gun and stop member properly positioned downhole in the illustrated manner of FIG. 1, pressure is applied at 22 slightly in excess of the calculated force required to shear pin 191. Upon the pins shearing, the lower edge portion of the piston moves against shoulder 31', thereby allowing the balls to be forced from thier respective cavities, whereupon the upper and lower members separate from one another, allowing the gun to fall downhole and where it impacts against member 34, as in the before described manner.

The presence of the discharged gun downhole adjacent the hydrocarbon producing formation is desirable in that high pressure flow from the perforations initially strike the gun housing rather than the opposed inside peripheral wall surface of the casing. Hence, the gases are diverted up the annulus formed between the gun and casing, thereby avoiding erosion of the inside wall surface of the casing in proximity of the production zone.

The pressure actuated releasable coupling of FIGS. 8 and 9 preferably is operated by connecting a suitable source of pressure to the tubing string through a suitable valve means, while all other outflow valves associated with the flow line 22 are closed to flow. The source of pressure can be compressible or non-compressible fluids, including water, liquid or gaseous hydrocarbons, and inert gases such as nitrogen, $CO_2$, and flue gases. The use of nitrogen, $CO_2$, or flue gases are employed to actuate the releasable coupling in order to keep a dry tubing string as well as a minimum hydrostatic head above the packer.

Where deemed desirable, a wireline actuated perforated nipple can be interposed between the packer and the releasable coupling apparatus, and the flow diverted into the perforated nipple.

It is considered within the comprehension of this invention to use an electrically fired gun mechanism at 32, as well as to separate the tubing at 27 with explosive means.

I claim:

1. Well completion apparatus for completing a formation located in a high temperature zone of a wellbore which underlies a low temperature zone, comprising; in combination:

a tubing string extending downhole in the wellbore, means supporting said tubing string within the wellbore, a releasable coupling means interposed within said tubing string, a perforating gun means connected to said releasable coupling means and supported in underlying relationship respective to said releasable coupling means, the length of said tubing string being of a value to dispose the gun means downhole at a location which lies within a low temperature zone of the wellbore;

detonator means connected to said gun means for causing the gun means to perforate a wellbore upon being actuated; means responsive to deceleration for actuating said detonator means;

and an abutment means which is located downhole in a high temperature zone of the wellbore for decelerating said gun means, thereby causing the gun to perforate the wellbore.

2. The combination of claim 1 wherein said means supporting said tubing string is a packer apparatus; said packer apparatus being interposed between the inside circumferentially extending wall surface of the wellbore and the outside circumferentially extending wall surface of the tubing string so that when the gun means is dropped and the wellbore is perforated, fluid must flow from the perforations, up the wellbore, into the tubing string at the separated releasable coupling, and up through the tubing string.

3. The combination of claim 1 wherein said detonator means is an explosive device arranged in underlying relationship respective to said gun means, said detonator means being exploded upon said detonator means striking said abutment means.

4. The combination of claim 3 wherein said releasable coupling means is comprised of an upper and lower member releasably fastened together by a releasing means, said releasing means including means by which it can be actuated by a wireline fishing tool.

5. In a wellbore which extends from a relatively low temperature zone downhole to a relatively high temperature zone, well completion apparatus comprising the combination of:

a perforating gun apparatus which includes a detonator means which fires said gun apparatus upon sudden deceleration thereof;

a tubing string, a releasable coupling means interposed within said tubing string such that the string can be parted into a lower and an upper marginal length thereof when the releasable coupling means is actuated; an abutment means against which said gun apparatus can be suddenly decelerated; and means by which said upper marginal length of said tubing string is supported within said wellbore;

means supporting said gun apparatus from said lower marginal length of said tubing string such that the gun apparatus is releasably positoned within said low temperature zone; means positioning said abutment means within said high temperature and in spaced relation to said gun apparatus;

whereby; said releasable coupling means can be actuated to cause the tubing string to part, thereby releasing said gun apparatus which falls downhole into engagement with said abutment means, whereupon said detonator means fires the gun apparatus to thereby perforate the wellbore so that the high temperature zone of the wellbore is completed.

6. The combination of claim 5 wherein said means by which said upper marginal length of said tubing string is supported includes a packer apparatus, said packer apparatus sealingly engaging and supporting the outer wall surface of the upper marginal length of the tubing string from the inner wall surface of the wellbore; so that fluid flow from the high temperature zone of the borehole is forced to enter the lower end of said upper marginal length of the parted tubing string, and flow uphole through the supported upper marginal length of said tubing string.

7. The combination of claim 5 wherein said detonator means is an explosive device arranged in underlying relationship respective to said perforating gun apparatus, said detonator means being exploded upon said gun apparatus striking said abutment means.

8. The combination of claim 7 wherein said releasable coupling is comprised of an upper and lower member releasably fastened together by a releasing means, said releasing means including means by which it can be actuated by a wireline fishing tool.

9. The combination of claim 5 wherein said detonator means is an explosive device arranged in underlying relationship respective to said perforating gun apparatus, said detonator means being exploded upon said gun apparatus striking said abutment means;

said releasable coupling means is comprised of an upper and lower member releasably fastened together by a releasing means, said releasing means including means by which it can be actuated by a wireline fishing tool;

said means supporting said tubing string includes a packer apparatus; said packer apparatus being interposed between the inside circumferentially extending wall surface of the wellbore and the outside circumferentially extending wall surface of the tubing string so that when the gun apparatus is dropped and the high temperature zone of the wellbore is perforated, fluid must flow from the perforations, up the wellbore, into the upper member of the separated releasable coupling, and up through the tubing string.

10. The combination of claim 9 wherein said tubing string extends to the uppermost end of said wellbore, a wellhead, including a Christmas tree, by which the uppermost end of said tubing string is supported;

whereby, said wellbore can be open flowed instantaneously upon perforation of the wellbore.

* * * * *

UNITED STATES PATENT OFFICE
CERTIFICATE OF CORRECTION

PATENT NO. : 3,990,507
DATED : November 9, 1976
INVENTOR(S) : Vann

It is certified that error appears in the above-identified patent and that said Letters Patent are hereby corrected as shown below:

Column 2 line 7, correct the spelling of "explosives".

Column 3 line 66, correct the spelling of "tubing".

Column 4 line 62, correct the spelling of "affixed".

Column 4 line 64, delete "affixed".

Signed and Sealed this

Twenty-second Day of March 1977

[SEAL]

*Attest:*

RUTH C. MASON
*Attesting Officer*

C. MARSHALL DANN
*Commissioner of Patents and Trademarks*